US005093971A

United States Patent [19]

Hein

[11] Patent Number: 5,093,971

[45] Date of Patent: Mar. 10, 1992

[54] METHOD AND APPARATUS FOR FORMING EXPANDED MESH BATTERY GRID AND GRID FORMED THEREFROM

[75] Inventor: Edward R. Hein, Mohnton, Pa.

[73] Assignee: Exide Corporation, Reading, Pa.

[21] Appl. No.: 527,063

[22] Filed: May 22, 1990

[51] Int. Cl.[5] ..... B21D 31/04

[52] U.S. Cl. ..... 29/6.1; 29/2

[58] Field of Search ..... 29/2, 6.1, 6.2

[56] References Cited

U.S. PATENT DOCUMENTS

| | | | |
|---|---|---|---|
| 1,195,222 | 8/1916 | Herr . | |
| 1,472,769 | 4/1921 | Naugle et al. . | |
| 1,578,365 | 6/1922 | Redding et al. . | |
| 1,818,246 | 4/1929 | Galbreath . | |
| 2,989,145 | 12/1957 | Goodloe | 183/71 |
| 3,276,096 | 11/1964 | McAleer et al. | 29/6.1 |
| 3,812,558 | 5/1974 | Watanabe | 29/6.1 |
| 3,867,200 | 2/1975 | Daniels, Jr. | 136/36 |
| 4,102,024 | 7/1978 | Badger et al. | 29/6.2 |
| 4,247,970 | 2/1981 | Bollinger | 29/6.1 X |
| 4,291,443 | 9/1981 | Laurie et al. | 29/6.1 |
| 4,297,866 | 11/1981 | Sakauye et al. | 72/186 |
| 4,305,187 | 12/1981 | Iwamura et al. | 29/2 |
| 4,315,356 | 2/1982 | Laurie et al. | 29/6.1 |
| 4,545,170 | 10/1985 | Shiray | 29/6.1 X |
| 4,649,607 | 3/1987 | Kuhn, II | 29/6.1 |
| 4,921,118 | 5/1990 | Gass | 29/6.1 X |

*Primary Examiner*—Timothy V. Eley

*Attorney, Agent, or Firm*—Volpe and Koenig

[57] ABSTRACT

A method and an apparatus for expanding a preslit deformable mesh sheet and an improved battery grid are disclosed. The method comprises the steps of positioning the lateral edges of the deformable strip with the same horizontal plane; laterally expanding the preslit portion of the strip while maintaining the lateral edges within the said horizontal plane; and vertically expanding the preslit portion of the strip selectively and concurrently with the lateral expansion thereof while maintaining the lateral edges in the horizontal plane. The apparatus comprises means for diverting one lateral edge from the other and laterally expanding the preslit portion of the deformable strip, while maintaining the lateral edges within the same horizontal plane, and means for vertically expanding the preslit portion of the deformable strip selectively and concurrently with the lateral expansion. The resultant grid embodies a degree of uniform expansion in a grid having varied interstices which is not found in the prior art grids.

9 Claims, 7 Drawing Sheets

METHOD AND APPARATUS FOR FORMING EXPANDED MESH BATTERY GRID AND GRID FORMED THEREFROM

BACKGROUND OF THE INVENTION

1. Field of the Invention

In general, the present invention relates to the production of expanded mesh sheets. In particular, the present invention relates to the production of expanded mesh sheets which are utilized to produce battery grids.

2. Prior Art

The prior art has long recognized the advantages to be gained by utilizing expanded mesh material in the formation of battery grids. There have been a number of efforts to produce a satisfactory grid and these efforts have produced a number of different approaches. One of the more recent approaches to the problems encountered with battery grids suggests expanding the slit and preformed portion of a metal strip by drawing opposite longitudinal edges of the strip apart so that the curved segments are substantially straightened while the nodes remain substantially in the plane of the strip to form the mesh sheet. Experience gained in efforts to practice this expansion method, as disclosed in U.S. Pat. Nos. 4,291,443 and 4,315,356, has shown that the disclosed method and apparatus does not produce satisfactory grids in those applications where the final pattern of grid interstices is not uniform. Accordingly, efforts were undertaken to develop an apparatus which would produce commercially acceptable grids having varied interstices.

To the extent that U.S. Pat. Nos. 4,291,443 and 4,315,356 disclose an apparatus for simultaneously slitting and preforming a portion of a metal strip prior to expansion, that apparatus is suitable for simultaneous use with the present invention and the description thereof is incorporated herein as if fully set forth.

As used hereinafter, the apparatus for slitting and preforming metal sheet will be generally referred to as a slitting head.

SUMMARY OF THE INVENTION

The present invention relates to both a method and an apparatus for expanding mesh sheet from a preslit deformable strip having unslit portions along at least the lateral edges thereof. The method comprises the steps of positioning the lateral edges of the deformable strip within the same horizontal plane; laterally expanding the preslit portion of the strip while maintaining the lateral edges within the said horizontal plane; and vertically expanding the preslit portion of the strip concurrently with the lateral expansion thereof while maintaining the lateral edges in the horizontal plane.

The apparatus comprises means for diverting one lateral edge from the other and laterally expanding the preslit portion of the deformable strip, while maintaining the lateral edges within the same horizontal plane, and means for vertically expanding the preslit portion of the deformable strip concurrently with the lateral expansion.

The resultant grid embodies a degree of uniform expansion in a grid varied interstices which is not found in the prior art grids.

DESCRIPTION OF THE PREFERRED EMBODIMENT

Figure 1:
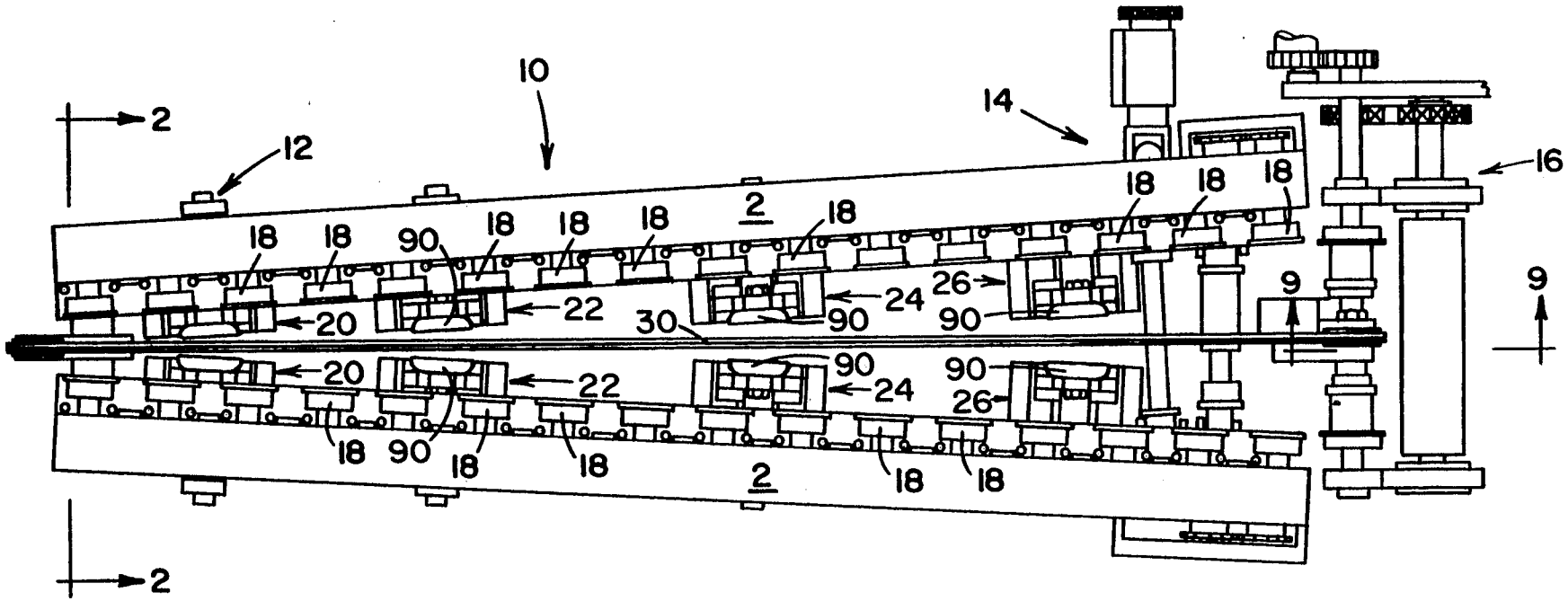
FIG. 1 is a top plan view of the expander apparatus in accordance with the present invention.

Turning now to the drawing figures, the preferred embodiment of the invention will be described in detail. With reference to FIG. 1, it can be seen that the expander 10 has an entrance end 12, an exit 14 and a final roller assembly 16 positioned immediately after and adjacent to exit 14. The slit and preformed sheet material enters the expander at the end 12 and is under continuous control through the final roller assembly 16. As noted previously, the slitting head, which does not form part of the present invention, may be in accordance with prior art teachings.

As can be seen with reference to FIG. 1, the preferred expander apparatus 10 has a longitudinal centerline and two lateral sides that diverge outwardly from the entrance 12 toward the exit 14. This divergence takes place about the center drive chain 30 and the opposite sides of the apparatus are mirror images of each other. A detailed explanation of one side of the apparatus will relate to the corresponding equipment on the other side thereof unless otherwise stated.

The apparatus is comprised of a longitudinal central base and two diverging lateral bases which form the supporting structure. The horizontal drive assemblies 2, having a plurality of horizontal drive rollers 18, are mounted on the diverging support structures and extend lengthwise or in the longitudinal direction of the expander 10. The apparatus also includes a plurality of vertical expansion assemblies, 20, 22, 24 and 26, which are paired on opposite sides of the center drive chain 30 and are distributed lengthwise or in the longitudinal direction of the expander.

Before discussing the expansion in detail, it will be beneficial to refer briefly to the sheet which is being expanded.

Figure 6:
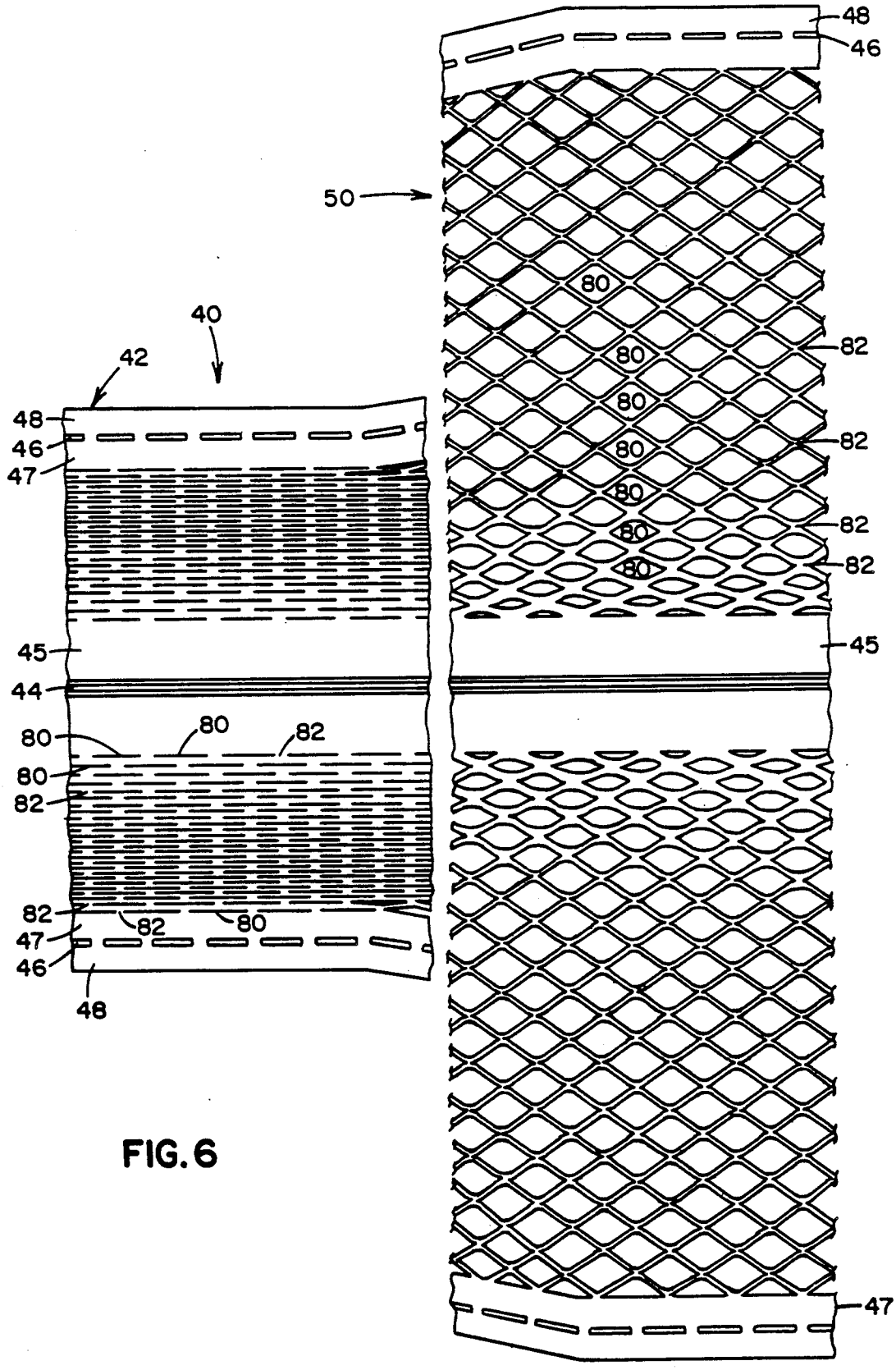
FIG. 6 is a top plan view illustrating a fragment of the sheet just prior to and during expansion and a fragment of the sheet fully expanded.

Referring now to FIG. 6, there is shown a slit and preformed metal sheet 40 as received from the slitting head and just prior to expansion. The slitting head simultaneously slits and preforms the sheet in a single operation as explained in U.S. Pat. Nos. 4,291,443 and 4,315,356. The sheet 40 has a continuous centerline projection 44 and a plurality of lateral edge projections 46 which have been formed by the slitting head. The centerline projection 44 cooperates with drive chain 30 and center support 58 of FIG. 2 to maintain the centerline of the sheet and to establish the horizontal plane as it progresses longitudinally through the expander. .The lateral edge projections 46 cooperate with the horizontal drive assembly 2 of FIG. 2 and the guiding system to cause diversion of the sheet material from the centerline as it progresses longitudinally through the expander. Still with reference to FIG. 6, the expanded sheet $o depicts a section of the expanded sheet product as it is about to exit at 14 and is rendered planar by the final roller assembly 16. As can be seen from a comparison of the sections shown in FIG. 6, the outward lateral edges of the sheet are the first areas to be expanded.

Figure 2:
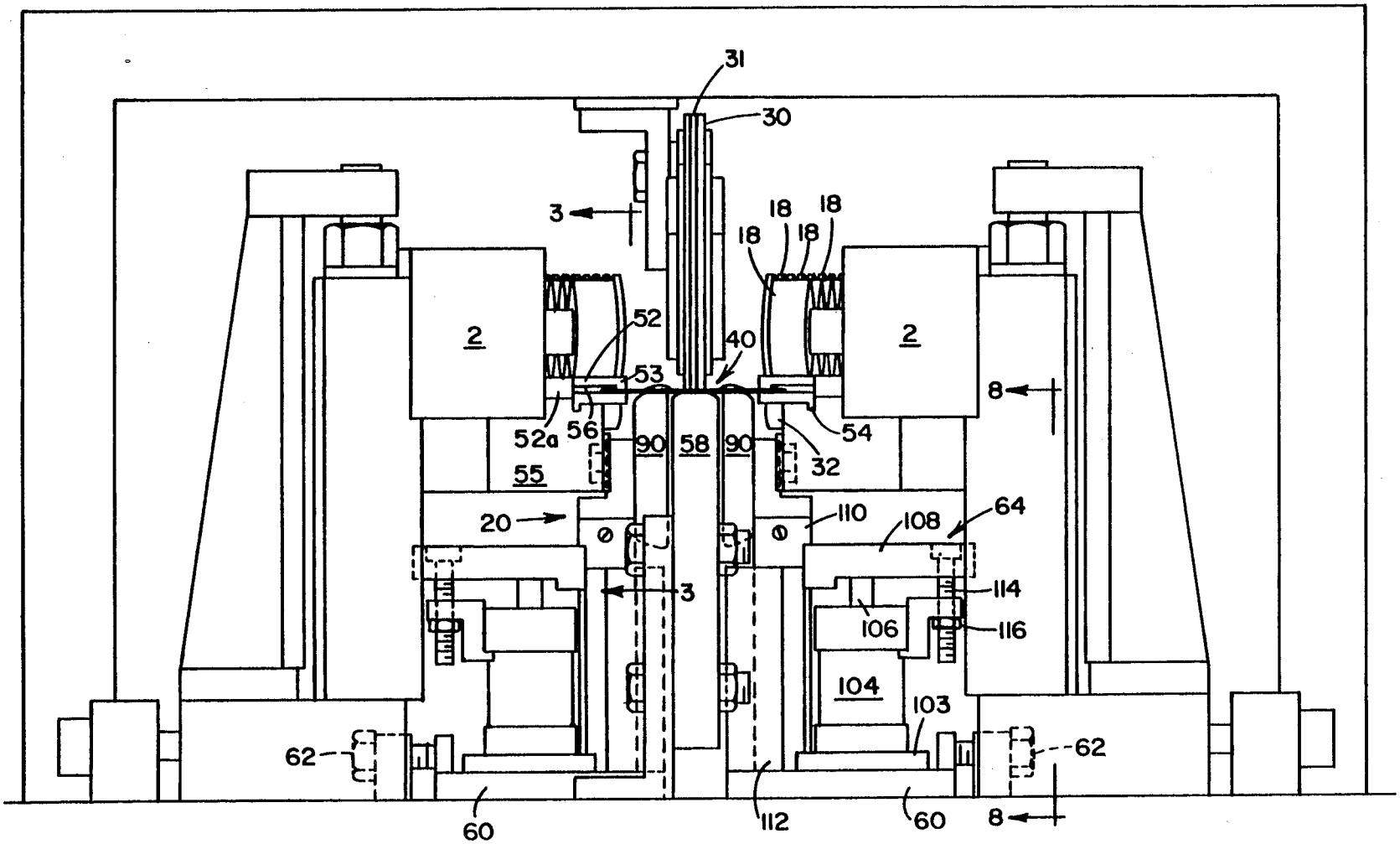
FIG. 2 is an end elevation of the expander apparatus taken in the direction of the arrows 2—2 of FIG. 1.

In order to understand how control is initially established over the slit and preformed sheet as it comes from the slitter head, reference is made to FIG. 2. FIG. 2 shows a view of the expander immediately after the slitting head, not shown. The sheet material 40 exits from the slitting head and comes under the control of the center drive chain 30, the guide tracks 56 and the roller assemblies 2.

It will be understood by those skilled in the art that the sheet material is initially hand fed during the start up period of the apparatus. Once the apparatus has established control over the sheet 40, drive chain 30, rollers 18 and 32 and guide tracks 56 will maintain that control. The drive chain 30 has a continuous groove 31 along the length of the chain in correspondence to the projection 44 on the sheet material 40. In the preferred embodiment, the unslit center strip is approximately 1 inch in width, the projection 44 is approximately ¼ inch × 1/16 inch, the drive chain 30 is a length of commercially available 5/8 inch silent chain and the recess 31 in chain 30 is approximately 3/16 inch × 1/16 inch. As illustrated in FIG. 2, the drive chain 30 is of sufficient size to permit formation of the recess 31 without substantial adverse impact on the strength of the drive chain 30.

Still with reference to FIG. 2, the guide track 56 is established by an upper guide plate 52 and a lower guide plate 54. Guide plate 52 is wider than guide plate 54 and includes the dependent portion **52*a* which extends beyond guide plate 54. In establishing the guide track 56, the top of guide plate 54 is substantially planar and the opposed surfaces of plate 52 is machined to form the actual clearance for guide track 56. The guide plate 54 is received within the dependent surface 52*a* of guide plate 52 but is spaced from the finger 53 by a distance which is substantially equal to but no less than the thickness of the sheet 40. The recess in plate 52 has been machined to a depth so that the track 56 is adjustable to substantially equal the height of the lateral projections 46 As can be seen from the foregone, the lateral projections 46 will abut the inner surface of finger 53. As may be expected, the distance between the recess 31 of drive chain 30 and the inner surface of finger 53 initially corresponds to the dimension of the unexpanded sheet and ultimately increases to the dimension of the fully expanded sheet. The machined surfaces are polished to reduce drag as the sheet 40** progresses through the track. If desired, the machined surfaces could be further finished, such as by chroming.

Again, with reference to FIG. 2, it can be seen that the plurality of horizontal drive rollers 18 diverge from the centerline defined by the drive chain 30 as they progress longitudinally towards the exit end 14 of the apparatus.

Also shown in FIG. 2 is a typical vertical expansion assembly 20. Expansion assembly 20 is comprised of a base 60 which is horizontally adjustable toward and away from the center support 58. Horizontal expansion assembly 20 also includes a vertical adjustment 64. As can be seen with reference to FIG. 2, the horizontal adjustment 62 and the vertical adjustment 64 permit selective placement of the vertical expansion roller 90. Further adjustment means for rotation of the assembly will be discussed in connection with FIG. 8 and 8A hereinafter. As shown in FIG. 2, the vertical expansion roller 90 is positioned to force the sheet material out of the horizontal plane defined by the guide tracks 56 and the interface of center support 58 and drive chain 30. As a result, selected portions of the slit and preformed sheet are periodically forced from the horizontal plane of the sheet during lateral expansion. Vertical expansion assemblies 20, 22, 24 and 26 are discussed in more detail hereinafter.

As will be understood by those skilled in the art, the sheet must be positively controlled as it moves through the apparatus and diverges from the centerline. Since the forces on either side of the centerline are substantially equal, cooperation between drive chain 30 and support 58 is sufficient to secure the centerline of the sheet and to assist in moving the sheet forward. Since the lateral edges of the sheet must progress forward and outward, additional control over the lateral edges of the sheet is believed to be necessary. A segment of the lateral drive and expansion means is shown in FIG. 3 and is explained in more detail below.

Figure 3:
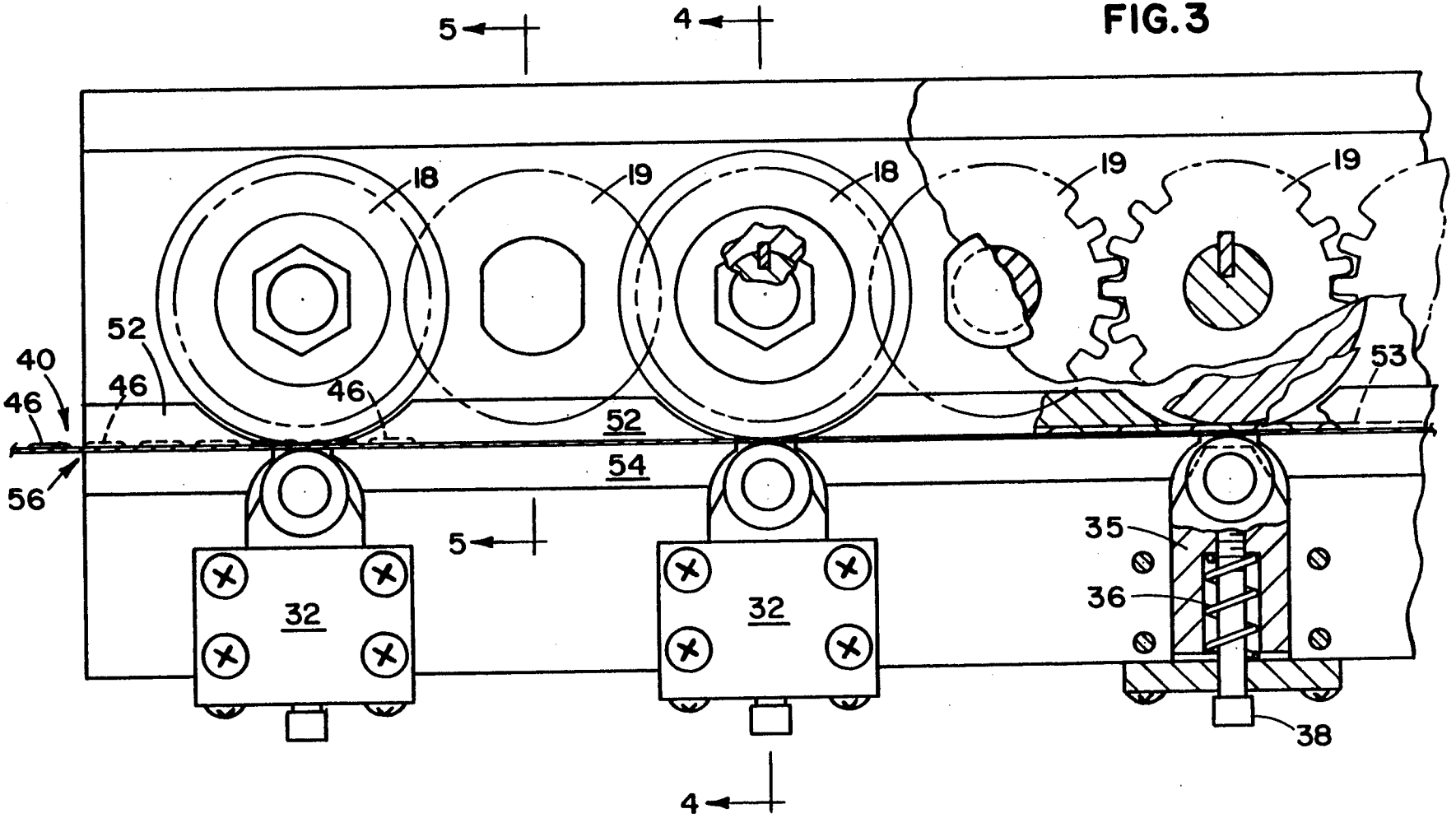
FIG. 3 is a section taken along the line 3—3 of FIG. 2.

With reference to FIG. 3, it is possible to see the cooperation between and among the horizontal drive rollers 18 and the upper and lower guides 52 and 54. As can be seen from the left hand side of FIG. 3, the sheet 40 substantially fills the guide track 56 and the lateral projection 46 is captured behind the finger 53 of upper guide plate 52. Each of the guide plates 52 is dimensioned to complement the adjoining drive roller 18. Each of the rollers 18 is positioned so that its circumference will extend just slightly into the guide track 56. Stated in another way, each roller 18 is positioned so that it will infringe upon track 56. Opposite each roller 18 is an idler assembly 32. Each idler assembly 32 is comprised of a roller 34 which is directly opposed to roller 18. Roller 34 is secured on an adjustment frame 35. Frame 35 is secured within assembly 32 and is normally urged toward roller 18 by the spring 36. A threaded adjuster 38 permits adjustment of the spring tension in order to control the position of roller 34. In the preferred position, roller 34 will infringe upon guide track 56 in the same manner as roller 18. As can be appreciated by those skilled in the art, rollers 18 and 34 will combine to effectively form a pinching means for gripping the sheet material 40 therebetween. Since the rollers are in continuous motion, this pinching action combines with drive chain 30 to move the sheet material progressively through the apparatus.

Still with reference to FIG. 3, the preferred means of driving the rollers 18 is a gear train having a plurality of gears 19. The use of such gear trains will be known to those skilled in the art and no further explanation is required here. It is preferred that the central and lateral movement of the sheet be synchronous. However, exact synchronization is not required. Since the drives rely upon a pinching action and friction, they are able to tolerate minor variations in drive speeds and slippage.

Figure 4:
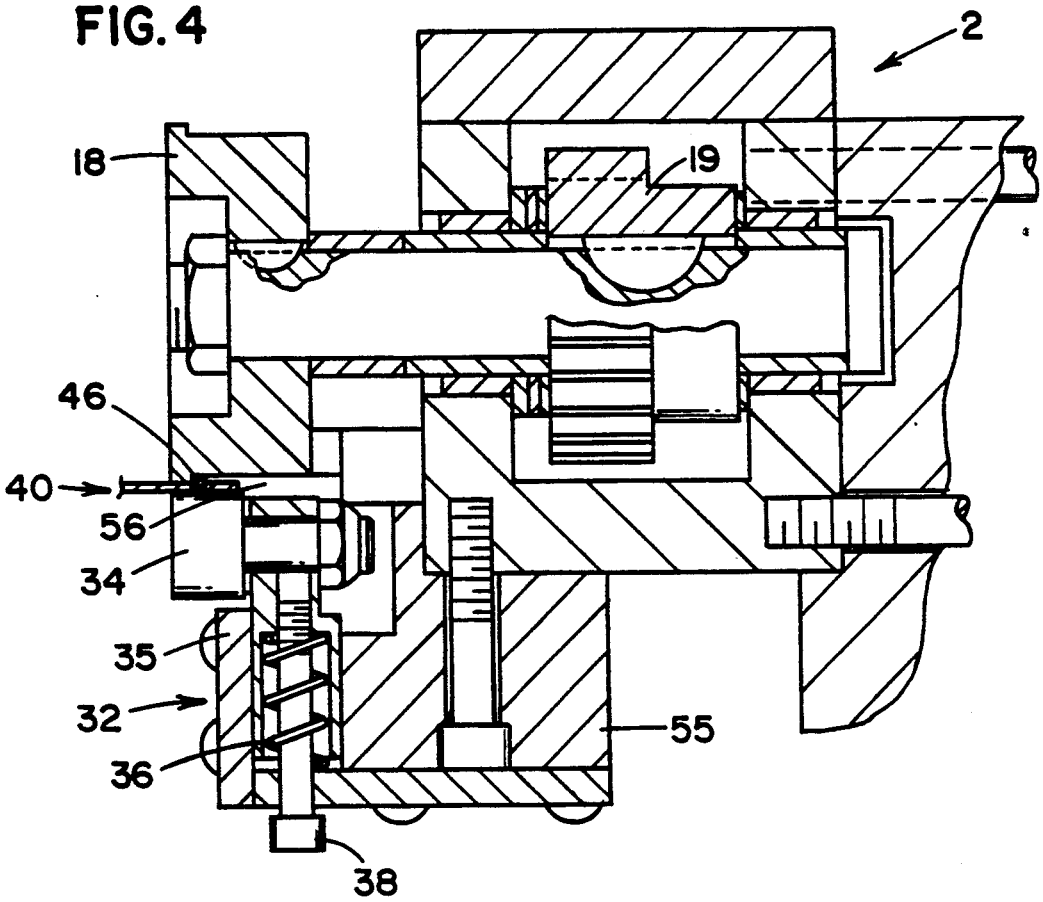
FIG. 4 is a section taken along the line 4—4 Of FIG. 3.

As can be seen in FIG. 4, controlled movement over the lateral expansion of the sheet material in the horizontal plane is maintained through the cooperation of rollers 18, 34 and track 56. As noted previously, roller 34 is controllable through threaded adjuster 38. When rollers 18 and 34 are properly positioned, they form a continuation of the guide track defined by upper and lower guides 52 and 54. As shown in FIG. 4 the roller 18 is configured to simulate finger 53 of upper guide 52 and the roller 34 has a surface like lower guide 54.

Figure 5:
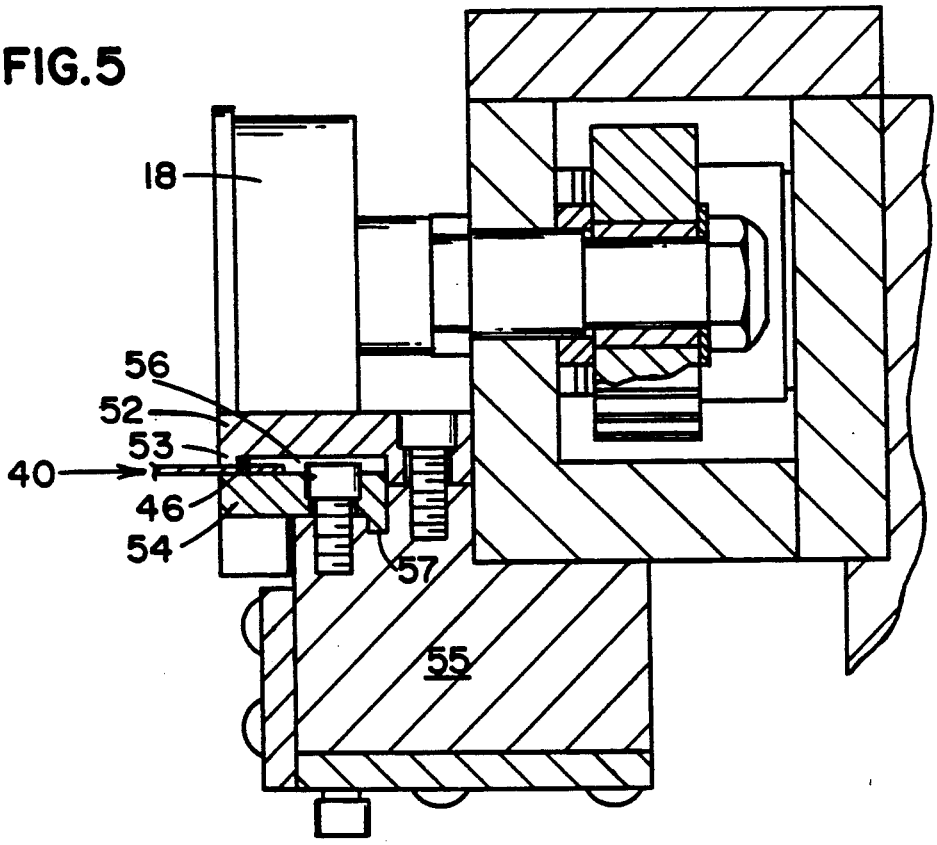
FIG. 5 s a section taken along the line 5—5 of FIG. 3.

As can be seen by reference to FIG. 5, the relative positions of the upper guide 52 and lower guide 54, and therefore, the position of guide track 56, are also adjustable. The guides 52 and 54 are secured to a guide mounting block 55. The mounting block 55 has a machine groove 57 which receives a portion of the lower guide 54. The relative position of the guides 52 and 54 may be adjusted through the use of shims. By placing shims beneath the guides 54 and/or 52 prior to securement to the mounting block 55, the relative position of the guide track 56 may be adjusted. It should be noted that the abutment of the upper guide 52 against the lower guide 54, which is secured within the groove 57, prevents movement of the guides in the horizontal plane. This assembly is intended to assure the accuracy of the guide position and to avoid movement during the expansion phase.

To this point, the described improvements have been limited to an expander apparatus which expands the metal sheet in the horizontal plane while maintaining the grid nodes substantially in the horizontal plane of the sheet. As noted previously, such a method of horizontal expansion has proven unsatisfactory for grids having varied interstices and/or nodes of different sizes.

Referring again to FIG. 6, the sheet material 40, after it has been slit and preformed by the slitting head is illustrated on the left side. It will be noted that the slits 80 are differentially spa ed and that the space between slits decreases as you progress outwardly from the center of the strip 40. Likewise, the connecting nodes 82 decrease in size as you progress outwardly. In the expanded grid 50, illustrated on the right side, it is possible to see the resultant variations in the interstices 80 as a result of the differential slot density and node thickness. When the expanded metal is ultimately die cut into battery grids, the area 47 adjacent the lateral projections 46 will be the foot portion of the grid and the areas 45 adjacent the central projection 44 will form the collector bar and tab of the grid, see FIG. 11.

Figure 7:
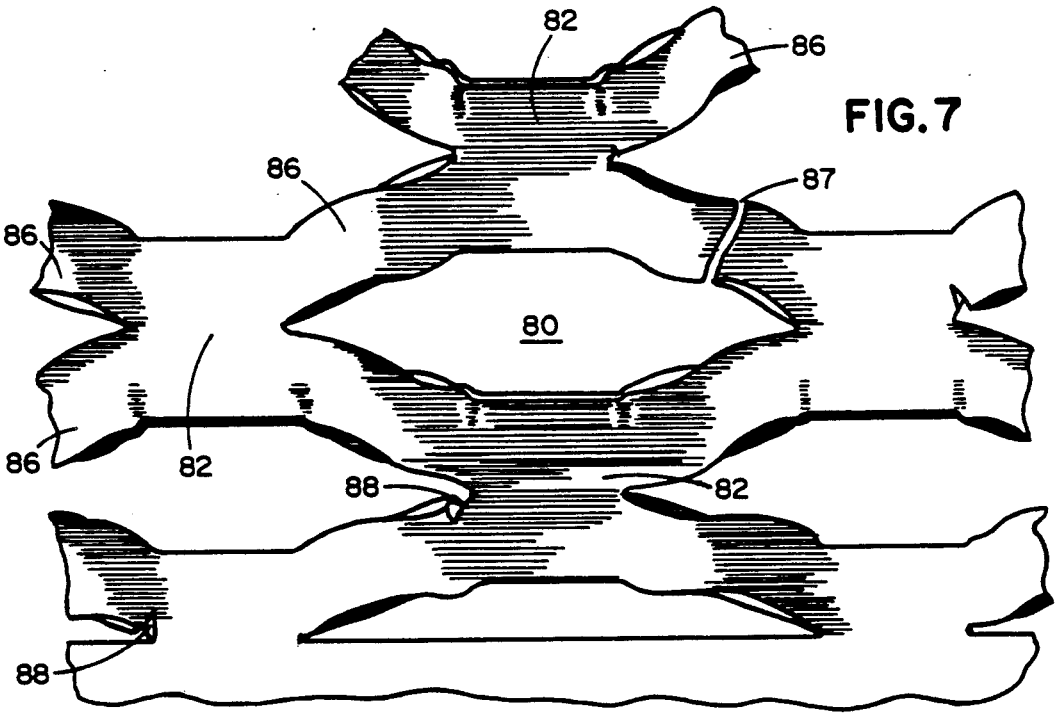
FIG. 7 is an illustrative enlargement of the circled area of FIG. 6 to show fragmentary cracks and the characteristic serpentine wires in an expanded grid.

When sheet material which has been slit and preformed by the slitting head is expanded by lateral expansion, the grid wires 86 have a characteristic convolute or serpentine configuration. In an expanded grid having differential slot density, node thickness and interstices, the heavier grid wires 86, which will define the small interstices near the centerline of the preslit and preformed material, are subject to a great degree of distortion. An example of this distortion is shown in FIG. 7. This differential distortion is believed to be one factor contributing to cracked and/or broken grid wires. Increased distortion is also believed to result in increased resistance to expansion. This increased resistance and the differential distortion appear to be cumulative in their detrimental effect.

With the present invention, it is expected that vertical expansion will produce a grid having differential interstices with substantially reduced consequences from grid wire distortion associated with differential nodes and interstices. Ideally, the effects of grid wire distortion will be substantially equal through the grid and product damage will be reduced.

As is known in the battery art, the grid wires 86 are preferably heavier in the area of the collector bar. As a result, the ratio of conducted metal to interstice area is higher adjacent the collector bar than it is adjacent the foot of the grid. This differential configuration results from expansion of the sheet which is not uniformly slit and preformed. Experience indicates that expanding such a nonuniform sheet while maintaining the nodes substantially within the horizontal plane of the sheet results in undesirable damage to the product and/or product which is not properly expanded.

Two forms of damage are illustrated in FIG. 7. As noted above, the differential interstice, grid wire and node sizes cause the rate and percentage of expansion among the various areas of the grid to differ. As a result, a plurality of weak spots or small cracks 88 and/or broken grid wire 87 may be formed in the final grid. While a certain number of defects can be tolerated, it will be recognized by those skilled in the art that a large number of minor defects, such as weak spots or small cracks, will result in an unacceptable product. Likewise, a smaller number of major defects, such as broken wires or unconnected nodes, will also result in an unaccepted product. In addition to product which is initially rejected, there is the associated problem of borderline product which is further damaged in processing or subsequently becomes unacceptable. Since broken wires and/or severed nodes adversely affect the conductivity of the grid and may adversely affect the life of the grid, it is most desirable to reduce or eliminate the cracks and weak spots.

In view of the above, it was decided that some vertical expansion of the grid wires and nodes out of the horizontal plane of the sheet was necessary to achieve the desired product. Furthermore, it was recognized that the vertical expansion had to be preformed selectively and progressively. Since the previously described apparatus for horizontal expansion substantially within the plane of the sheet provided for continuous control over the sheet, it was decided that vertical expansion had to be accomplished without loss of control over the sheet. Furthermore, it was decided that a vertical expansion from the horizontal plane of about 10% of the preslit sheet width would not adversely affect the nodes, would not cause rotation of the nodes or grid wires and would improve grid uniformity. Furthermore, it was decided that incremental vertical expansions of about 10% would permit the sheet material to return to its horizontal configuration between vertical expansions. Given an initial sheet width between the centerline and lateral edge of 1¾ inches, the vertical expansion on each side of the centerline is about 1/5 of an inch.

With the above in mind, it was determined that at least two and preferably four independent vertical expansions should be undertaken throughout the length of the expander apparatus. Referring again to FIG. 1, there are shown four vertical expansion assemblies 20, 22, 24 and 26. In the preferred embodiment, all of the assemblies parallel the lateral edges of the expander and are spaced from the central drive chain 30 by an increasing amount. The rationale for this arrangement can be understood by making additional reference to FIG. 6. As the initial sheet material is presented to vertical expansion assembly 20, the entire sheet is tightly configured and the first area of vertical expansion is concentrated in the area closest to the center strip of the sheet material. At the same time, the first area of horizontal expansion is the area closest to the lateral edge of the sheet material. As the sheet material is expanded in the horizontal plane, it will be expanded in the vertical plane. Once the sheet material has passed the vertical expansion assembly 20, the previously expanded material will be drawn back into the horizontal plane. As it approaches the second vertical expansion assembly 22, the previously vertically expanded portion has moved outwardly toward the lateral edge. Accordingly, the second vertical expanding assembly 22 has been spaced from the centerline by a distance which is calculated to effect the second vertical expansion in the grid area adjacent to that which has been previously expanded. Once again, the vertically expanded portion will be generally pulled back into the horizontal plane by the continued horizontal expansion. In accordance with the foregone, the third assembly 24 and the fourth assembly 26 are likewise spaced from the centerline. In this manner, it is possible to obtain localized vertical expansions which do not adversely rotate the nodes or grid wires.

It will also be seen from reference to FIG. 1 that the contact roller 90 of each of the vertical expansion assemblies is tapered toward the lateral edges. Since the sheet material is moving longitudinally and horizontally, it is desirable to avoid friction or drag forces on the grid. Therefore, it is expected that roller 90 will be tapered to complement the vertical extension of the grid. As a result of this configuration, the sheet material will be momentarily expanded vertically from the plane of the sheet material and will have a controlled descent back into the plane of the sheet material.

Figure 8A:
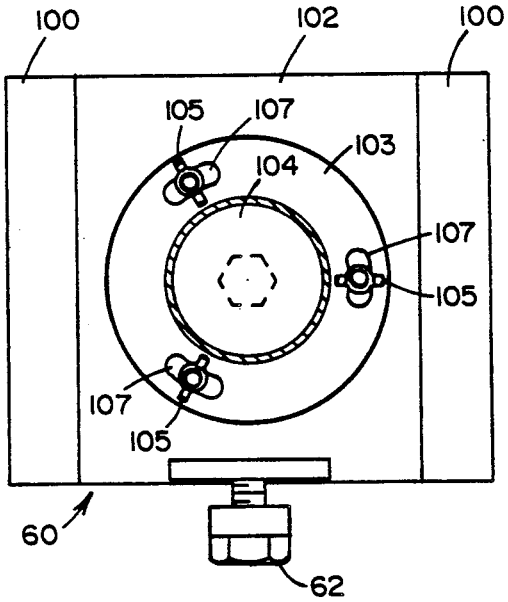
FIG. 8A is a section through the line 8A—8A of FIG. 8.
Figure 8:
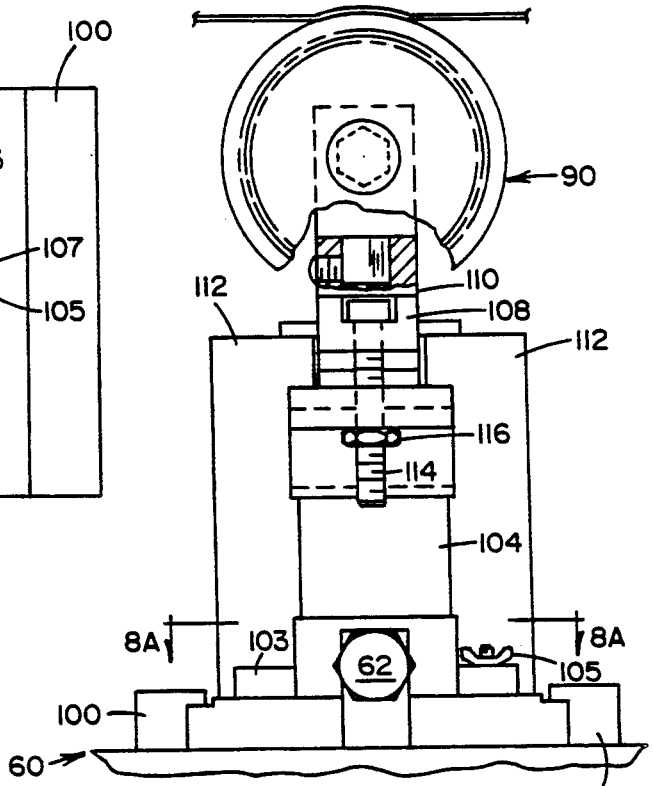
FIG. 8 is a side elevation along the line 8—8 of FIG. 2 for an exemplary vertical expansion assembly in accordance with the present invention.

By way of further explanation of a typical vertical expansion assembly, reference is made to FIGS. 8 and 8A. The base 60 is comprised of two guides 100 and a slide block 102 which is horizontally positioned through the adjuster 62. The guides 100 are fixed in position and the adjuster 62 extends through the support structure from the outer lateral side of the expander. By manipulation of adjuster 62, the slide mount 102 may be moved toward or away from the centerline of the apparatus. The support 104, in the preferred embodiment, is a hydraulic cylinder mounted on a rotatable base 103 which is secured on slide block 102.

Still with reference to FIG. 8A, it can be seen that the adjustment of slide block 102 will control the position of the cylinder 104 with respect to the centerline of the apparatus. Rotation of the base plate 103 is controlled by the locking means 105 and a guide means or slot 107. The base 103 is attached to slide 102 so that it is vertically secure but is still rotatable. One means of accomplishing this attachment is a center through bore in the base 103 and a tapped bore in slide 102 which accepts a shoulder bolt, shown in phantom, to fasten base 103 against vertical movement while permitting rotation. The locking means 105 is comprised of a threaded fastener which passes through an arcuate slot 107 in base 103 and mates with a threaded bore in slide 102. By releasing the fastener 105, the slot 107 will permit free movement of the base to the desired position. Thereafter, the fastener is tightened down against the base 103 and the position is locked. Other means of securing the vertical position while permitting rotation will be known to those skilled in the art. Likewise, other means for rotational adjustment will be known to those skilled in the art.

With reference to FIG. 8, the piston 106 is attached to the carrier plate 108. The carrier plate 108 is secured to a bearing block 110, FIG. 2, on which the roller 90 is mounted. The bearing block 110 rides in two vertical guides 112. The travel of piston 106 and the height of carrier 108 is adjusted by the threaded shaft 114 which is locked in place by the fastener 116. Although an entirely mechanical adjustment could be utilized for the vertical expansion assembly, the hydraulic assembly is preferred. Through the use of this hydraulic assembly, the roller 90 may be lowered below the horizontal plane during initial set up operations. Once the sheet material has been fed through the apparatus, the hydraulic cylinder 104 Can be activated to raise the roller 90 into the contact position. Through the use of a lock means, such as fasteners 116, the degree of vertical travel is reproducible. In addition to reproducibility, this adjustment permits the use of differential amounts of vertical expansion at each selected position.

As noted previously, the cylinder 104 is mounted for rotational movement. In the preferred embodiment, the cylinder 104 is mounted so that it may, preferably, be rotated plus or minus ten degrees, $\pm 10°$, from a perpendicular through the centerline of the sheet. Through this rotation, it is possible to control the angle of contact between the roller 90 and the sheet 40. This rotational adjustment in cooperation with the horizontal and vertical adjustments permits great latitude in establishing the point of contact between the roller 90 and the sheet 40.

As can be seen by reference to FIGS. 1, 2, 8, and 8A, it is possible to selectively expand the sheet material in the vertical direction and to modify the degree and angle of vertical expansion along the apparatus. This flexibility results in an apparatus which is particularly well suited to variations in grid designs.

Figure 9:
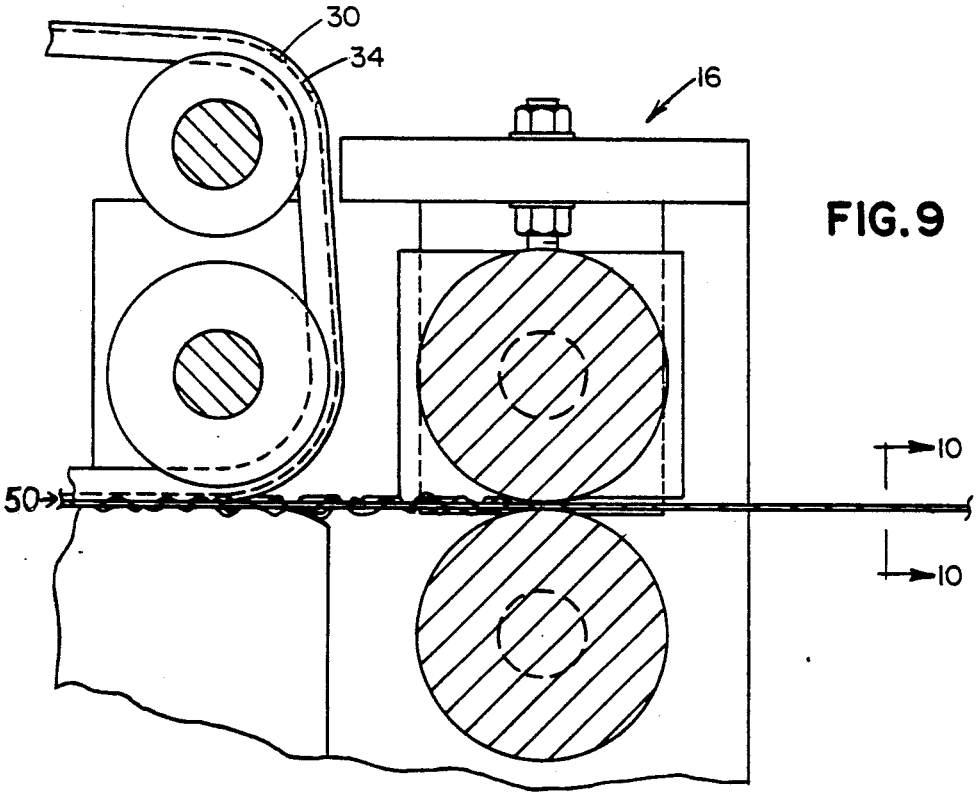
FIG. 9 is a section taken along the line 9—9 of FIG. 1.
Figure 10:
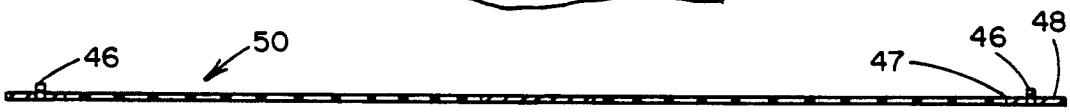
FIG. 10 is a section taken along the line 10—10 of FIG. 9

As will be recognized by those skilled in the art, the foregone manipulations of the expanded sheet will result in some waviness and irregularities in the horizontal plane. Accordingly, control will be maintained over the expanded sheet material as it is fed to the final roller assembly 16. As can be seen from FIG. 9, the expanded sheet 50 is passed between the opposed rollers of roller assembly 16 to render it planar and remove the centerline projection as shown in FIG. 10. The final product as it exits assembly 16 is normally passed to a lead pasting machine and then die stamped into the grid configuration illustrated in FIG. 11. The lead paste has been omitted in FIG. 11 to illustrate the final grid construction.

Figure 11:
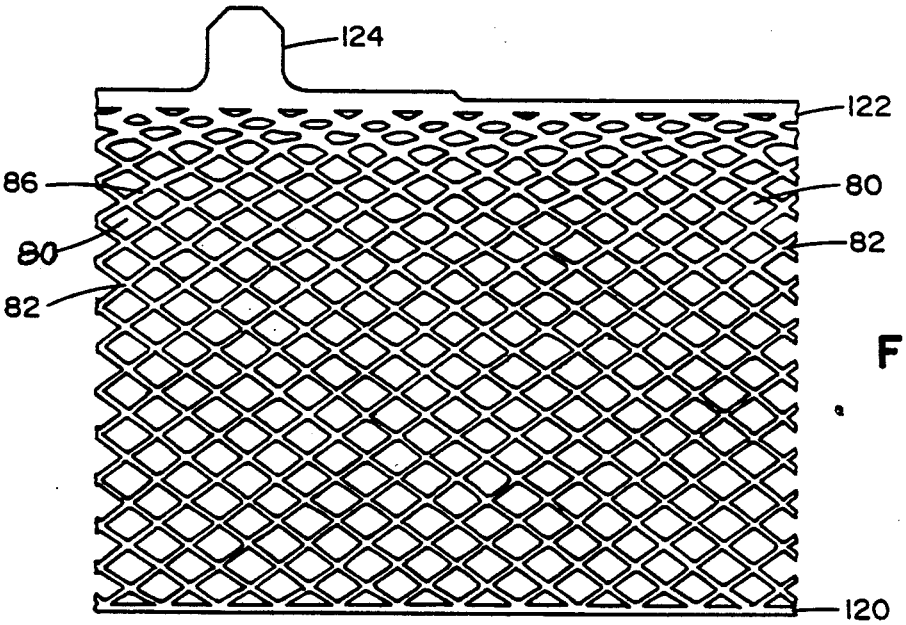
FIG. 11 is a front elevation of a final unpasted grid.

With reference to FIG. 11, it can be seen that the final grid will have a foot portion 120, a collector portion or collector bar 122 and a tab 124. As can be seen from FIG. 11, the interstices are essentially parallelograms and the grid wires run in a continuous line from the foot 120 to the collector bar 122 and are generally parallel to each other. It can also be seen from FIG. 11 that the upper portion of the grid just adjacent to the collector bar, comprising about ten percent (10%) of the grid area, has greatly reduced interstices and greatly increased node sizes. However, the grid wires continue to maintain a generally parallel configuration and the serpentine nature of the wires is maintained. The improved uniformity in the grid configuration is believed to be beneficial with respect to uniform current flow and collection through the grid. As will be understood by those skilled in the art, a plurality of like grids are interconnected through the tabs 24 in the formation of a battery element. Since each of the grids within the element is a contributor to the whole and can result in rejection of the whole, the improved quality of the present grid is believed to be a substantial advantage over the prior art grids.

I claim:

1. A method of expanding mesh sheet from a preslit deformable strip having unslit portions along the lateral edges thereof, said method comprising the steps of:

positioning the lateral edges of the deformable strip within a common horizontal plane;

laterally expanding the preslit portion of the strip while maintaining the lateral edges within the said horizontal plane; and vertically expanding the preslit portion of the strip selectively and concurrently with the lateral expansion thereof while maintaining the lateral edges within the said horizontal plane.

2. An apparatus for expanding mesh sheet from a preslit deformable strip having unslit portions along the lateral edges thereof, said apparatus comprising:

means for diverting one lateral edge from the other and laterally expanding the preslit portion of the deformable strip while maintaining the lateral edges within the same horizontal plane; and means for vertically expanding the preslit portion of the deformable strip selectively and concurrently with the lateral expansion.

3. The apparatus of claim 2 wherein the means for vertically expanding the preslit portion of the deformable sheet is further comprised of at least three separate expansion assemblies.

4. The apparatus of claim 3 wherein each expansion assembly includes at least one expansion roller.

5. The apparatus of claim 3 wherein each expansion assembly includes an expansion roller subassembly.

6. The apparatus of claim 5 wherein each expansion roller subassembly includes at least one expansion roller.

7. The apparatus of claim 5 wherein each said expansion roller subassembly includes means for adjusting the vertical position of the expansion roller subassembly.

8. The apparatus of claim 7 wherein each expansion roller subassembly includes at least one expansion roller.

9. The apparatus of claim 7 wherein the expansion assemblies are spaced apart from each other and are generally parallel to the diverging lateral edge of the expanding preslit portion of the deformable strip.

* * * * *